US007510448B2

(12) United States Patent
Eppe et al.

(10) Patent No.: US 7,510,448 B2
(45) Date of Patent: Mar. 31, 2009

(54) CLAMPING CONNECTION, CONNECTING TERMINAL ARRANGEMENT AND INSTALLATION SWITCHING DEVICE

(75) Inventors: Klaus-Peter Eppe, Waldbrunn (DE); Carola Thielen, Birkenau-Loehrbach (DE); Albert Stieger, Plankstadt (DE); Richard Hack, Nussloch (DE)

(73) Assignee: ABB Patent GmbH, Ladenburg (DE)

( * ) Notice: Subject to any disclaimer, the term of this patent is extended or adjusted under 35 U.S.C. 154(b) by 0 days.

(21) Appl. No.: 11/867,872

(22) Filed: Oct. 5, 2007

(65) Prior Publication Data

US 2008/0085639 A1 Apr. 10, 2008

(30) Foreign Application Priority Data

Oct. 6, 2006 (DE) ..... 10 2006 047 255
Sep. 17, 2007 (DE) ..... 10 2007 044 262

(51) Int. Cl.
*H01R 4/48* (2006.01)

(52) U.S. Cl. ..... 439/835; 439/729

(58) Field of Classification Search ..... 439/828, 439/834–835, 839, 846, 784–786, 729
See application file for complete search history.

(56) References Cited

U.S. PATENT DOCUMENTS 2,027,220 A * 1/1936 Benson ..... 439/786
5,575,695 A * 11/1996 De Bernardis ..... 439/838
7,234,981 B2 * 6/2007 Eppe et al. ..... 439/834

FOREIGN PATENT DOCUMENTS

EP 1 575 130 A1 9/2005

* cited by examiner

*Primary Examiner*—Truc T Nguyen
(74) *Attorney, Agent, or Firm*—Buchanan Ingersoll & Rooney PC

(57) ABSTRACT

Clamping connection for connecting a conductor to an installation switching device, comprising a clamping spring, acting on the conductor end as compression spring, for clamping tight the conductor end at an abutment, wherein the clamping connection comprises a conductor bar with a connecting end and an adjoining discharge area, the conductor bar has at the connecting end a window-like opening with a support edge and a clamping edge, opposite the support edge, at the transition of the connecting end into the discharge area, the clamping spring has a support leg by means of which it is supported on the support edge of the conductor bar, and the support leg is adjoined by an arc piece which is adjoined by a clamping leg, so that the conductor end can be clamped tight between the clamping leg and the clamping edge as abutment.

20 Claims, 7 Drawing Sheets

CLAMPING CONNECTION, CONNECTING TERMINAL ARRANGEMENT AND INSTALLATION SWITCHING DEVICE

RELATED APPLICATIONS

This application claims priority under 35 U.S.C. §119 to German Application 10 2006 047 255.1 filed in Germany on Oct. 6, 2006, and to German Application 10 2007 044 262.0 filed in Germany on Sep. 17, 2007, the entire contents of which are hereby incorporated by reference in their entireties.

TECHNICAL FIELD

A clamping connection for connecting a conductor to an installation switching device, for example a circuit breaker, an earth-leakage circuit breaker or a motor protection switch, with a clamping spring, acting as compression spring on the conductor end, for clamping the conductor end to an abutment, and a connecting terminal arrangement and an installation switching device with a generic terminal connection.

BACKGROUND INFORMATION

From EP 1 575 130, a generic terminal connection is known in which a number of plug-in openings and a holding opening are present in a contact frame. The clamping spring is held at a first free end in the holding opening at the contact frame and is divided at its second free end by one or more slot-shaped recesses into a number of finger-like extensions corresponding to the number of plug-in openings. Each of the extensions is conducted through in each case one of the plug-in openings and in each of the plug-in openings, a conductor can be clamped tight by in each case one of the extensions. At the contact frame, a connecting part for attaching a further electrical outgoing conductor into the switching device is formed. The clamping spring is supported on a support edge at the transition between the contact frame and the connecting part. The connecting part is bent up in the direction of the plug-in direction of the connecting conductor. In a terminal connection according to EP 1 575 130, only a narrow web at the contact frame is available for the current path from a connecting conductor clamped on towards the connecting part. The contact resistance from the connecting conductor clamped on to the further electrical outgoing conductor into the switching device is correspondingly large. For each connecting conductor to be clamped on, a separate terminal window is available, separated by a busbar. As a result, the terminal connection according to EP 1 575 130 becomes relatively wide so that it does not fit into switching devices having only half the standard module width.

According to DIN 43 880, a module a is defined for the module width of installation switching devices. According to this standard, the module width is an integral or half-integral multiple of 17.5 mm, more precisely:

$$a = n \times (17.5\ \text{mm} + 0.5\ \text{mm}),\ n = 0.5;\ 1.5;\ 1.5;\ 2.0, \ldots.$$

An installation switching device having half a standard module width therefore has a module width of 9 mm.

SUMMARY

It is the object of the disclosure, therefore, to create a generic terminal connection for the screwless connection of one or more connecting conductors, which has a low contact resistance and can be built into installation switching devices having only half a standard module width.

According to the disclosure, the clamping connection comprises a conductor bar with a connecting end and an adjoining discharge area. The conductor bar has at its connecting end a window-like opening with a support edge and a clamping edge, opposite the support edge, at the transition of the connecting end into the discharge area. The clamping spring also has a support leg with which it is supported on the support edge of the conductor bar. The support leg is adjoined by an arc piece which is adjoined by a clamping leg, so that the conductor end can be clamped tight between the clamping leg and the clamping edge as abutment. The conductor end can be introduced into the window-like opening from the side of the arc piece.

Due to the fact that the clamping edge is located at the transition of the connecting end into the discharge area, the entire width of the conductor bar is available for the current flow from the connecting conductor, clamped to the clamping edge, to the discharge area so that a low contact resistance can be achieved.

Furthermore, the connecting end only has one window-like opening into which, if necessary, the two connecting conductors to be connected are clamped. As a result, the terminal connection can be made so narrow that it can be installed in an installation switching device of only half a standard module width.

In an exemplary embodiment of the disclosure, the clamping leg of the clamping spring can be longitudinally slotted for facilitating the clamping-on of two connecting conductors, so that two closely adjacent part-springs, which can be clamped independently of one another, are produced. Due to the fact that the two part-springs are close together, that is to say without having a separating, relatively large intermediate space or an intermediate web between them which is approximately in the centre, a further contribution is made towards a narrow construction of the terminal connection so that the terminal connection according to the disclosure can be installed in an installation switching device having only half a standard module width.

According to an exemplary embodiment of the disclosure, the arc piece is adjoined by a first part-clamping leg which merges at a bending edge into a second part-clamping leg, bent away from the first part-clamping leg, so that the first and second part-clamping leg assume an obtuse angle with one another, the opening of which points into the direction of insertion of the connecting conductor.

The obtuse angle between the first and the second part-clamping leg provides the advantage that an advantageous point of application for a spring actuating means is located in the vicinity of the bending edge. If it is placed into the vicinity of the bending edge between the first and the second part-clamping leg, the point of placement of the spring actuating means can have a greater distance from the point of rotation of the clamping leg at the arc piece without the maximum terminal opening which can be achieved as a result becoming smaller and without the spring actuating means being in the way of a connecting conductor having a large cross section. However, a greater distance between the point of placement and the point of rotation means a more advantageous lever ratio and thus a lower actuating force for the user. Thus, a further problem in previously known screwless connecting terminals in installation switching devices can be advantageously solved. This is because, for introducing a connecting conductor, the clamping leg is usually bent by means of an actuating means in such a manner that a window for introducing connecting conductors is produced between the clamping edge of the clamping leg and the clamping edge of the conductor bars. If connecting conductors having a large conductor cross section are to be inserted, it is necessary that the window becomes large enough. In the terminal connection according to EP 1 575 130, the point of application of the spring actuating means must come to lie relatively close to the bent piece of the clamping spring. Otherwise, the spring actuating means would be in the way of the connecting conductor. The consequence is, however, that a lever ratio is produced which is disadvantageous for the operator. The actuating force which has to be exerted by the user when pressing on the pressure area of the terminal cover part to open the terminal is correspondingly relatively large in clamping connections according to the prior art. A clamping connection according to the disclosure can reduce the actuating force.

An exemplary embodiment is characterized by the fact that the conductor bar is approximately U-shaped, the connecting end forming one U-leg and the discharge area being formed by the crossbar and the other U-leg.

In this arrangement, the clamping spring runs outside the U-shaped conductor bar so that, when it is installed into the terminal connecting space of a switching device, it is accessible there for an actuating tool or a tightening element.

According to a further exemplary embodiment, an upward bend for attaching further conductor bars leading into the interior of the installation switching device can be provided at the free end of the other U-leg.

According to a further embodiment, a discharge bar can also be moulded on at the free end of the other U-leg. The discharge bar can extend approximately perpendicularly to the other U-leg and the side of the connecting end opposite to the clamping edge can be supported on the discharge bar. From the conductor bar and the discharge bar, a closed terminal frame is thus produced which is stable in itself. This increases the mechanical stability of the terminal connection.

This is because it produces the advantage that the forces acting on the terminal connection during the insertion and detachment of the connection conductor are absorbed by it as a closed system. When the terminal connection according to the disclosure is installed in an installation switching device, connecting forces which are produced, for example, during the opening of the clamping contact by an actuating tool, are thus internally absorbed in the terminal frame and now only act on the support points of the terminal frame in the housing but not on other elements of the installation switching device.

A connecting terminal arrangement according to the disclosure in a terminal connection space, accessible through a housing opening, of an installation switching device comprising a clamping connection according to the disclosure is characterized by the fact that the clamping connection is arranged in the terminal connection space in such a manner that a part of the conductor bar, namely the discharge area, is accessible from the outside as calibration contact area. The calibration contact area is needed for electrical contacting during the calibration of the thermobimetal in an installation switching device when a connecting terminal arrangement according to the disclosure is installed. It is known that during the calibration of the thermobimetal, it must be checked whether the time delay of the thermobimetal during heating due to an overcurrent of a particular intensity corresponds to the values prescribed in accordance with the respective tripping characteristic. For this purpose, an overcurrent which is supplied via the said calibration contact is selectively applied to the installation switching device in its final production step.

In previously known installation switching devices which use connecting terminal arrangements according to the prior art, the contact point for the calibration of the thermobimetal is arranged at another place outside the access area of the terminal connection and is not accessible via the terminal connection. Since the thermobimetal can only be calibrated in the finished assembled state, separate access openings to the calibration contacts must be covered by additional covering parts following the calibration in known installation switching devices.

This is not necessary when connecting terminal arrangements according to the disclosure are used in an installation switching device. In this case, the discharge area of the conductor bar of the terminal connection according to the disclosure in the connecting terminal arrangement according to the disclosure is used as calibration contact. Compared with the prior art, this saves both assembly parts—namely the additional covering parts—and production steps in the assembly so that a further advantage is obtained from the resultant simplification of assembly.

A further connecting terminal arrangement according to the disclosure in a terminal connection space, accessible through a housing opening, of an installation switching device comprising a clamping connection according to the disclosure and a terminal cover part covering the housing opening, with a test opening, is characterized by the fact that the clamping connection is arranged in the terminal connection space in such a manner that a part of the clamping spring is allocated to the test opening in the terminal cover part and, as a result, electrical test contacting can be carried out from the outside with the terminal cover part in place.

In an installation switching device according to the disclosure with a housing comprising two shell-shaped housing parts, with a front and rear face, a connecting side, front and rear narrow sides and wide sides, at least one terminal connection according to the disclosure is fixed in position in a terminal connection space of the housing.

According to an exemplary embodiment of an installation switching device according to the disclosure, the terminal connection space is laterally limited by the housing wide sides and open at least towards the front face, and the opening of the terminal connection space can be covered by a terminal cover part which is swivelably connected to the housing and which has a connection area with a number of terminal openings corresponding to the number of connecting conductors to be connected and guiding means, moulded onto each terminal opening, for the connecting conductors, and spring actuating means are moulded onto the cover part and arranged in such a manner that, when the cover part is swivelled against a clamping spring, they load the latter so as open it.

In a further exemplary embodiment, the terminal cover part can be resiliently loaded by the clamping spring in opposition to the direction of insertion of the external connecting conductor, and can be pressed against the clamping spring. In this arrangement, the spring actuating means can be formed by the guiding means, moulded onto each terminal opening, for the connecting conductors.

In an installation switching device according to the disclosure, one or more terminal connections according to the disclosure, arranged at the outgoing side, and one or more conventional screw terminals, arranged at the incoming side, can be arranged.

BRIEF DESCRIPTION OF THE DRAWINGS

The disclosure and other exemplary embodiments and improvements of the disclosure will be explained and described in greater detail with reference to the drawings, in which 3 illustrative embodiments of the disclosure are shown. In the drawings.

DETAILED DESCRIPTION

In the figures, identical or identically acting components or elements are in each case provided with identical reference numbers even if they are configured in slightly modified form in different variants of the embodiment.

Figure 1:
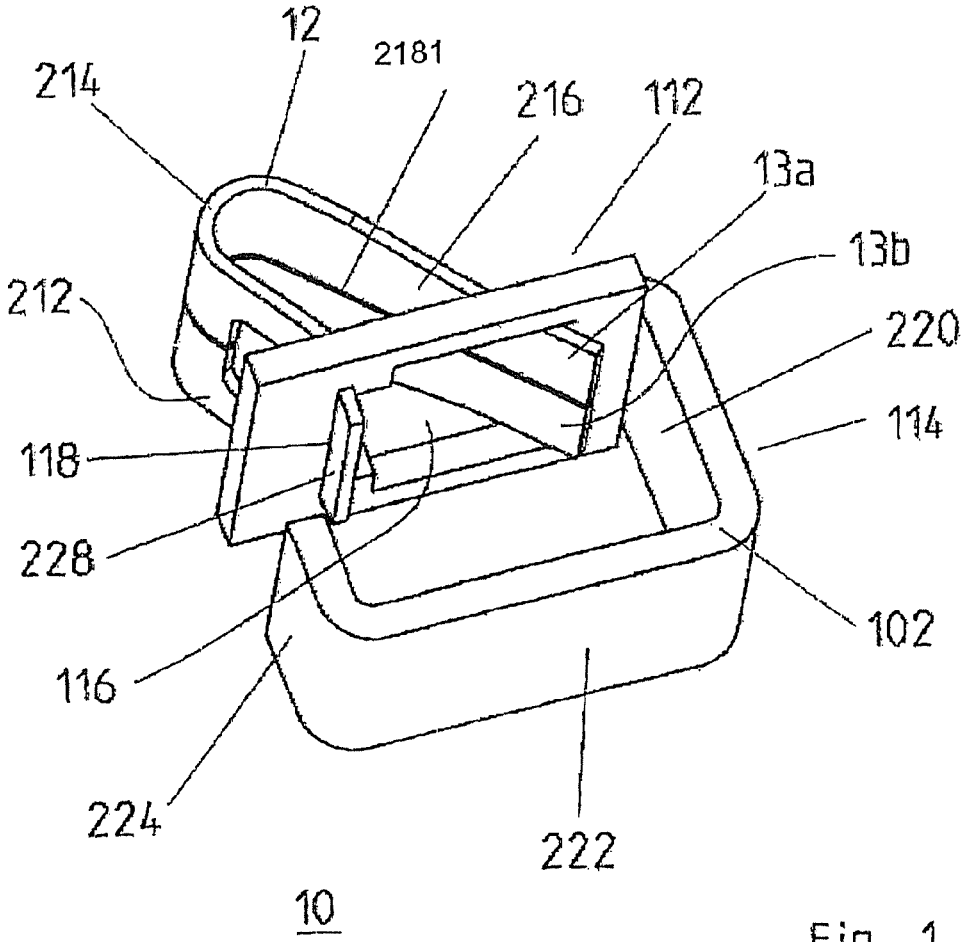
FIG. 1: shows a diagrammatic view of a terminal connection according to the disclosure in a first embodiment.
Figure 2:
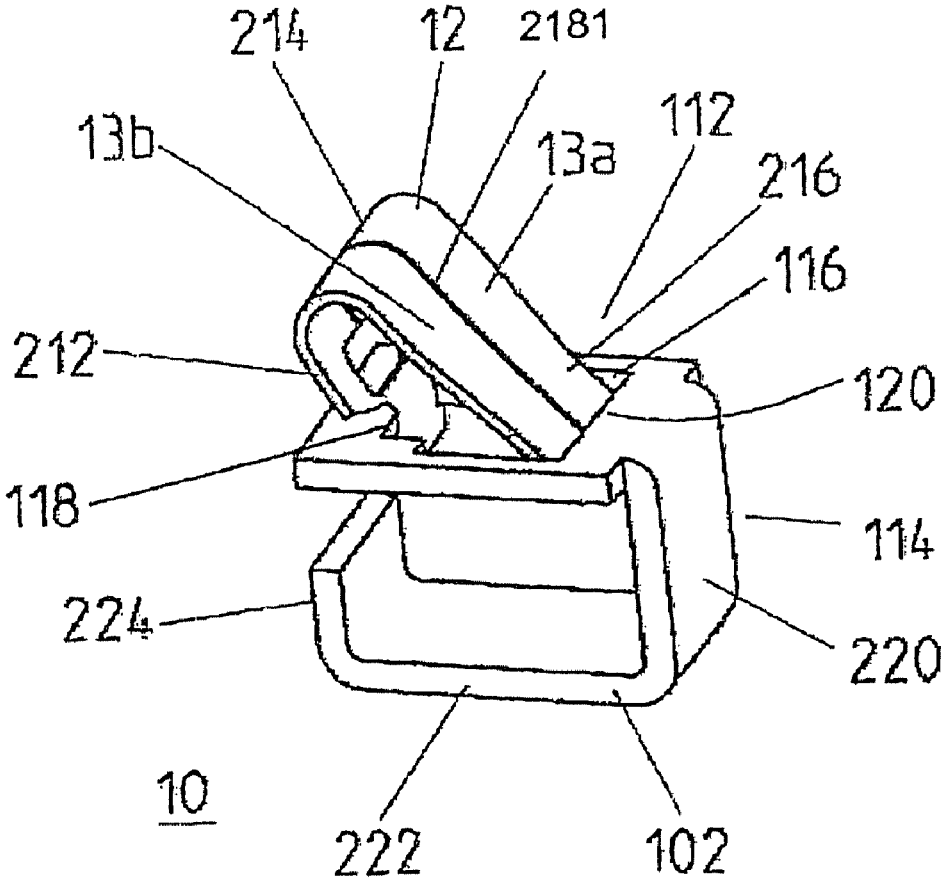
FIG. 2: shows a view of the terminal connection according to FIG. 1 obliquely from above.
Figure 3:
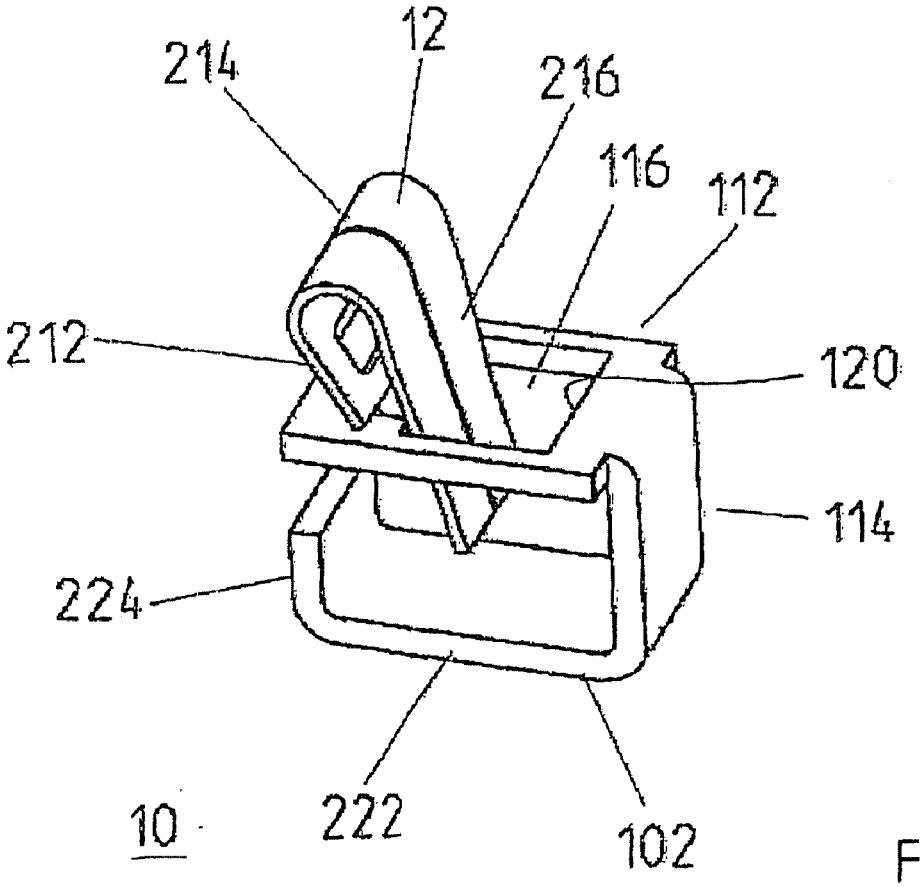
FIG. 3: shows a view of the spring force terminal of the installation switching device according to the disclosure according to FIG. 1, in the open state.

Initially, FIG. 1 will be considered. The terminal connection 10 comprises a conductor bar 102 and a clamping spring 12. The conductor bar 102 comprises a connecting end 112 and an adjoining discharge area 114. At the connecting end 112, it has a window-like opening 116 with a support edge 118 and a clamping edge 120 opposite the support edge 118. The clamping edge 120 is located at the transition of the connecting end 112 into the discharge area 114.

The clamping spring 12 has a support leg 212 with which it is supported on the support edge 118 of the conductor bar 102. The support can be effected in such a manner that the supporting leg 212 has at its free end an upward bend 228 with which it partially encloses the support edge 118 for the purpose of supporting.

The support leg 212 is adjoined by an arc piece 214 which is adjoined by a clamping leg 216. The conductor end 16 of a connecting conductor 14 (see FIG. 5) is inserted into the window-like opening 116 from the side of the arc piece 214 and can be clamped tight between the clamping leg 216 and the clamping edge 120 acting as abutment. In this arrangement, the free end of the clamping leg 216 passes through the window-like opening 116.

The clamping leg 216 of the clamping spring 12 is longitudinally slotted along a slot 2181 so that two part-springs 13*a*, 13*b* are produced which can be clamped independently of one another and by means of which two connecting conductors 14 can be clamped on independently of one another.

The conductor bar 102 has an approximately U-shaped basic form, the connecting end 112 forming the first U-leg and the discharge area 114 being formed by a crossbar 220 and the second U-leg 222. At the free end of the second U-leg 222, an upward bend 224 is attached. At this upward bend 224, further connecting conductors can be attached by means of which the terminal connection 10 is connected to other assemblies within the switching device housing such as, for example, the release assemblies. In particular, the connecting conductors can be welded or hard-soldered to this upward bend 224, and screwing-on is also possible.

Figure 4:
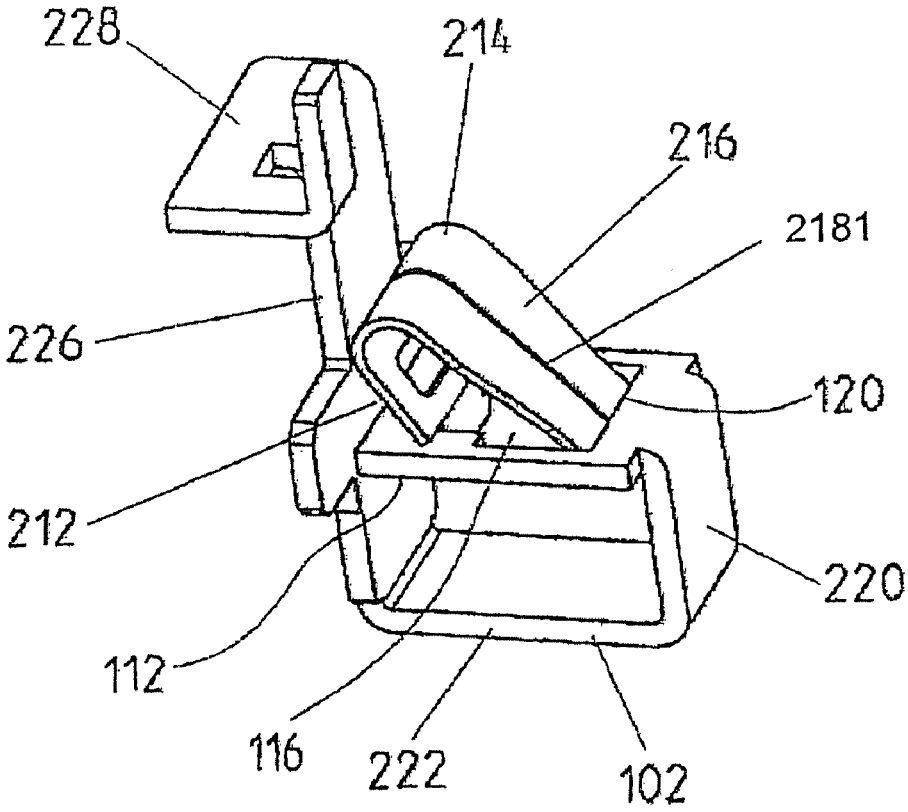
FIG. 4: shows a diagrammatic view of a variation of the spring force terminal according to FIG. 1

In an alternative embodiment of a terminal connection which is shown in FIG. 4, the upward bend is elongated at the free end of the second U-leg 222 to form a discharge bar 226. The discharge bar 226 is thus positively joined to the second U-leg 222; it points approximately perpendicularly from the latter in the direction of the window-like opening 116 and protrudes above it. At the free end of the discharge bar 226, a further upward bend 228 is located to which further internal connecting conductors can be welded or riveted. The upward bend 228 can, however, also be used directly as terminal connection within the switching device. Overall, the conductor bar 102 according to the present embodiment is provided with an external contour which resembles the small letter "b". The connecting end 112 of the conductor bar 102 is supported against the discharge bar 226. This increases the mechanical stability of the terminal connection 10.

Furthermore, the advantage is obtained that the forces acting on the terminal connection 10 during the insertion and detachment of the connecting conductor are absorbed by it as a closed system and thus forces acting on other elements of the installation switching device such as, for example, the housing, are reduced.

The conductor bar 102 can be produced in very large numbers inexpensively and simply and in a wide variety of shapes for example as a punched bent part. The clamping spring 12 can be produced from a piece of bent spring strip.

Figure 5:
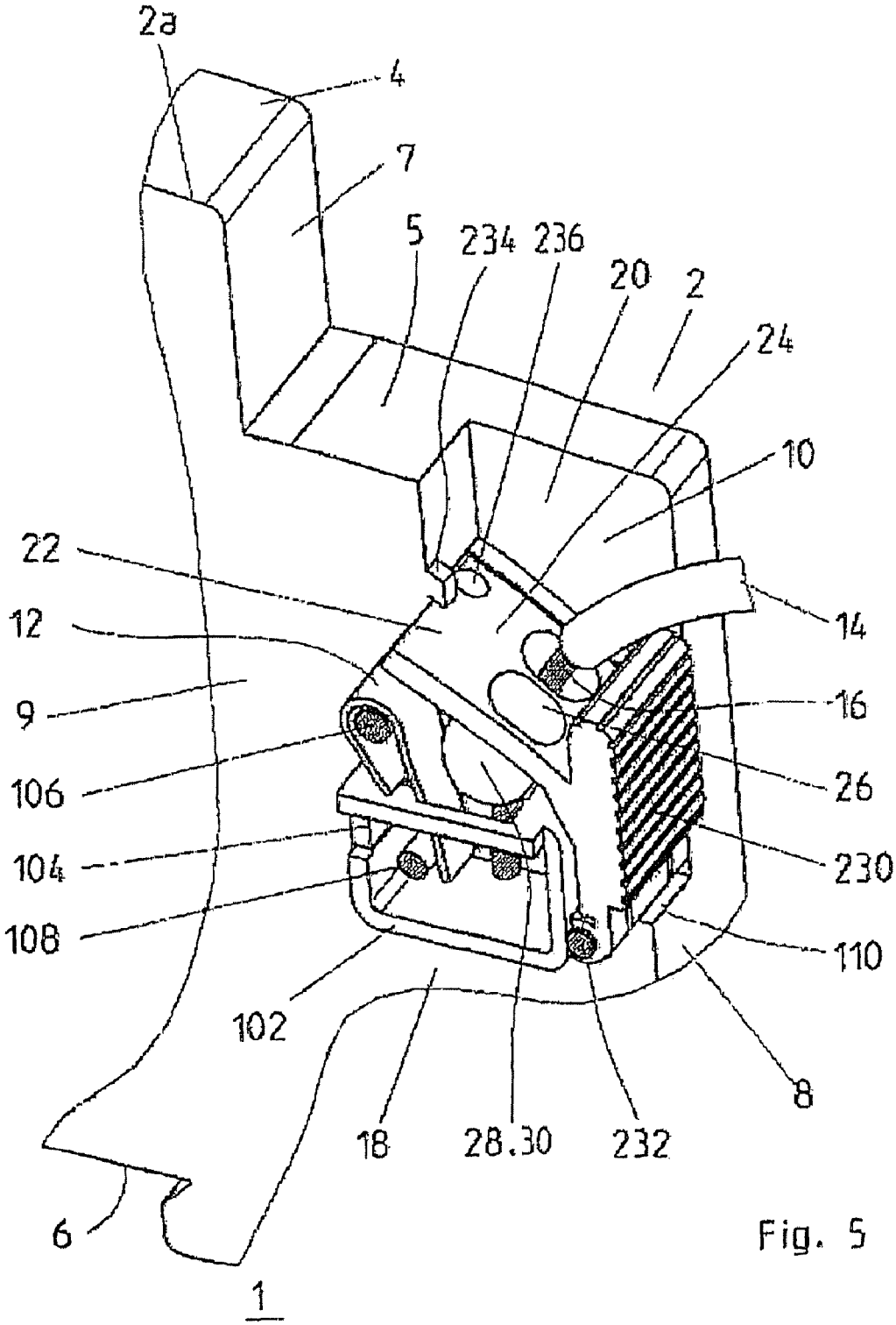
FIG. 5: shows a diagrammatic partial sectional view of an installation switching device according to the disclosure

FIG. 5 shows a partial sectional view of the terminal connection space 18 of an installation switching device 1 according to the disclosure with the housing opened, with a terminal connection 10 according to the disclosure fixed in position therein.

The installation switching device 1 has a housing of insulation material formed from two housing parts 2 (only one housing part of which is shown in FIG. 5), joined together along a partition line 2*a*, with a front face 4, a rear face 5, an attachment side 6, a front narrow side 7, a rear narrow side 8 and wide sides 9.

The terminal connection space 18 is limited laterally, that is to say towards the wide side, by the housing wide sides 9 of the insulating housing. Towards the front face 4, an opening 20 of the terminal connection space 18 is formed by a recess in the rear face of the housing part 2, through which the terminal connection 10, fixed in position in the terminal connection space 18, is accessible for the connection of connecting conductors 14. Due to a further opening at the rear narrow side 8 of the housing part 2, the opening 20 of the terminal connection space 18 extends past the contact edge between the rear narrow side 8 and the rear face 5 into the rear narrow side 8. This has the advantage that increased flexibility is given for the direction of connection of the connecting conductor 14.

The terminal connection 10 rests on a projection 110 formed on the inside of the wide side 9 and is there fixed in position in the terminal connection space 18 in a manner known per se by means of webs 104 and pins 106, 108. The terminal connection 10 fixed in position in the terminal connection space 18 is thus located between the rear narrow side 8 and the rear face in the area of the contact edge.

The opening 20 of the terminal connection space 18 is covered by a terminal cover part 22 swivelably connected to the housing 3. The terminal cover part 22 is constructed to be approximately L-shaped, the two legs being formed by cover plates located at an angle to one another.

The first cover plate covers the terminal connection space 18 towards the rear face 5 and has a connecting area 24, with two terminal openings 26, wherein one connecting conductor 14 can be connected through each of the terminal openings 26.

The second cover plate covers the terminal connection space 18 towards the rear narrow side 8 and has a pressure area 230 which is accessible from the outside and which can be manually operated. At its free edge, the second cover plate has a half open tube-like cavity with which it is supported rotatably in a hinge pin 232 connected to the wide side 9 of the housing 3. The terminal cover part 22 can thus be swivelled around the free edge of the second cover plate in the direction of the clamping spring by means of pressure on the pressure area 230. Falling-out of the cover part 22 is prevented by a projection 234 at the housing wall, which is used as stop.

At the first cover plate of the cover part 22, tube-like hollow bodies 28 forming a lead-in conduit are attached at each of the terminal openings 26, aligned towards the clamping spring 12. These are used at the same time as guiding means for the connecting conductor 14 to be inserted and as spring actuating means. When the cover part 22 is swivelled in the direction of the clamping spring 12 around the pivot pin 232 by pressure on the pressure area 230, the hollow bodies 28 press the clamping leg 216 in the clamping spring 12 away from the clamping edge 120 of the conductor bar 102 so that space for inserting the stripped connecting conductor end 16 of the connecting conductor 14 is produced between the clamping edge 120 and the clamping leg 216. FIG. 5 shows this condition.

If, after the insertion of the connecting conductor end, the pressure area 230 of the cover part 22 is released again, the clamping leg 216 of the clamping spring 12, due to its spring force, again presses the cover part 22 outward over the hollow bodies 28 and, at the same time, clamps the end 16 of the connecting conductor 14 against the clamping edge 120 of the window-like opening 116.

In the embodiment according to FIG. 5, two terminal openings 26 exist in the connecting area 24 of the cover part 22, and behind each terminal opening 26, a tubular hollow body 28 is located, moulded onto the connecting area, as guiding means for the connecting conductor and as spring actuating means 30. In this arrangement, each terminal opening 26 and each guiding means 28 is allocated to one of the two partial clamping springs 13*a*, 13*b* as have been produced by the slot 2181 in the clamping spring 12. Thus, if two conductors are to be clamped on, a conductor 14 is inserted through each of the two terminal openings 26 and clamped on by in each case one of the partial clamping springs 13*a*, 13*b*. The connecting conductors 14 are separated and guided in the hollow bodies 28 used as guiding means for the connecting conductors 14 and thus no separate guiding or separating devices are required at the terminal connection 10. In particular, it is not required to subdivide the opening 116 into two receiving spaces by means of a web. The terminal connection 10 can thus be constructed in a very simple and narrow manner so that it can be installed in an installation switching device of half a module width.

Due to the spring force of the clamping spring 12, the cover part 22 is pressed outward against the projection 234 in a state of rest so that the cover part always assumes a defined position in the state of rest.

The cover part thus fulfils two functions: on the one hand, the functions of guidance of the connecting conductors and, on the other hand, the function of the spring actuating tool. Both rigid and flexible conductor ends can be clamped in and also removed again from the terminal by means of the device according to the disclosure, without an external actuating tool for the clamping spring.

Naturally, there could also be an additional slot in the connecting area 24 of the cover part 22 through which an external tool could then be pushed for operating the clamping spring 12.

Furthermore, a test opening 236 is arranged in the connecting area 24. The clamping spring 12 can be electrically contacted by means of a test probe through this test opening.

In the embodiment shown in FIG. 5, the connecting area 24 of the cover part 22 extends inclined towards the rear face 5. The guiding means 28 are approximately perpendicular to the connecting area 24. The angle of inclination with which the connecting conductor 14 is introduced into the terminal is thus determined by the angle of inclination of the connecting area 24. An embodiment is also conceivable in which the connecting area 24 extends approximately in parallel with the rear face 5 and the guiding means 28 are inclined with respect to the connecting area 24. The angle of inclination with which the connecting conductors 14 are inserted into the terminal is then determined by the angle of inclination of the guiding means 28 with respect to the connecting area 24.

The cover part 22 can be produced very advantageously as a plastic injection moulding in one injection process.

Figure 6:
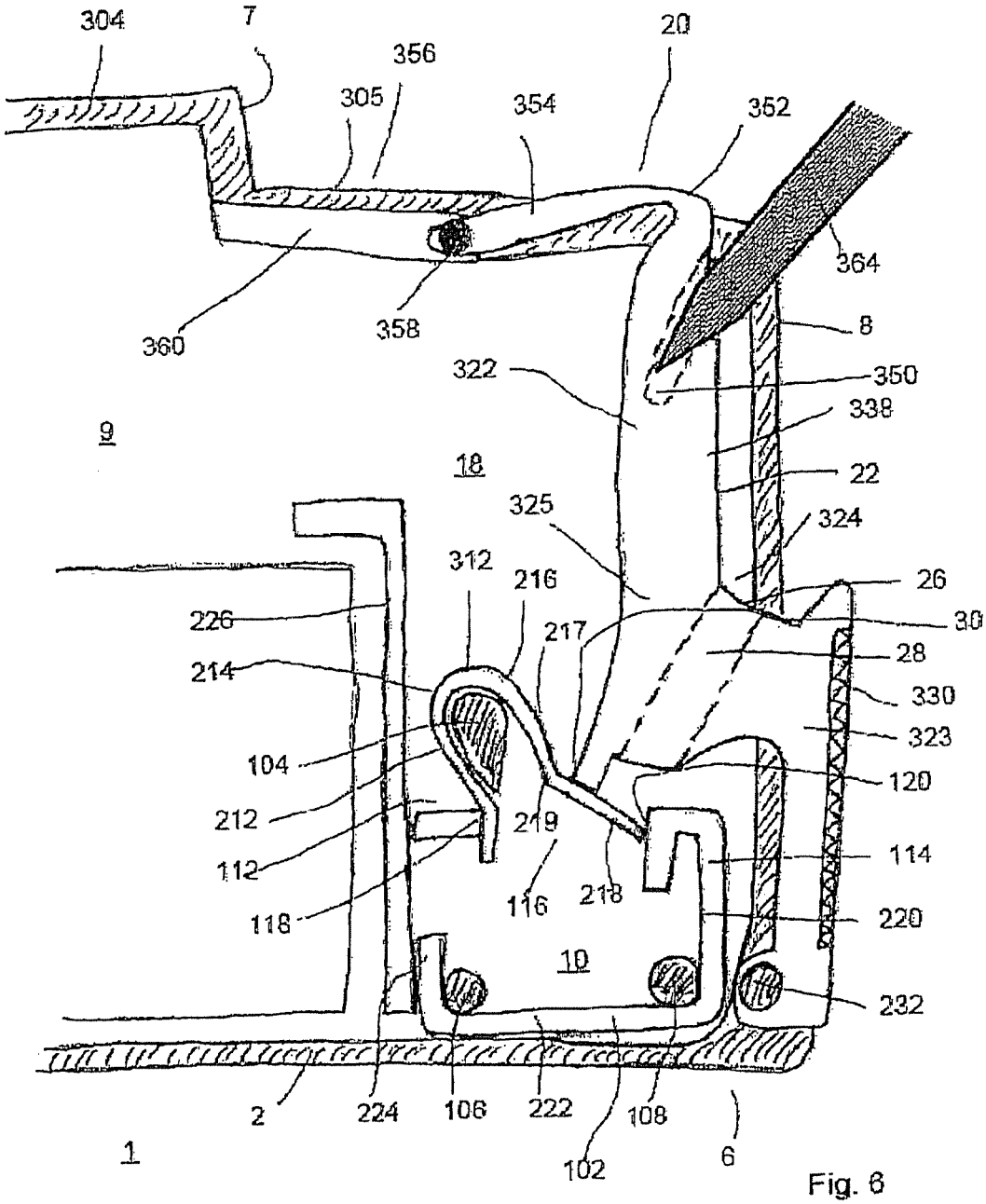
FIG. 6: shows a diagrammatic partial sectional view of an installation switching device with a further terminal connection according to the disclosure, with the terminal closed.

FIG. 6 shows a partial sectional view of an installation switching device with a further embodiment of a terminal connection according to the disclosure.

The installation switching device 1 according to FIG. 6 has an insulating housing, formed of two housing parts 2, with a front face 304, a rear face 305, a mounting side 6, a front narrow side 7, a rear narrow side 8 and two wide sides 9, only one of which, located in the plane of the drawing, is shown in the view according to FIG. 6.

The terminal connection space 18 is limited laterally, that is to say towards the wide side, by the housing wide sides 9 of the insulating housing 3.

Towards the front face 304, an opening 20 of the terminal connection space 18 is formed by an opening in the rear face 305 of the housing part 2, through which the terminal connection 10, fixed in position in the terminal connection space 18, is accessible for the connection of connecting conductors 14. The front narrow side 7 is initially adjoined by a part piece 356, at the housing side, of the rear face 305. This produces an opening 20 at the rear face 305 in the area between the end of the part piece 356 at the housing side, facing away from the front narrow sides 7, and the rear narrow side 8.

Due to a further opening at the rear narrow side 8 of the housing part 2, the opening 20 of the clamping connection space 18 extends beyond the contact edges between the rear narrow side 8 and the rear face 305 into the rear narrow side 8. This has the advantage that increased flexibility is given for the direction of connection of the connecting conductor 14.

The terminal connection 10 comprises a conductor bar 102 and a clamping spring 312. The terminal connection 10 is fixed in position in the terminal connection space 18, in a manner known per se, on the inside of the wide side 9 by means of webs 104 and pins 106, 108. The terminal connection 10, fixed in position in the terminal connection space 18, is located between the rear narrow side 8 and the rear mounting side 6 in the area of the contact edge.

The conductor bar 102 of the terminal connection 10 comprises a connecting end 112 and an adjoining discharge area 114. At the connecting end 112, it has a window-like opening 116 with a support edge 118 and a clamping edge 120 opposite the support edge 118. The clamping edge 120 is located at the transition of the connecting end 112 into the discharge area 114.

The clamping spring 12 has a support leg 212 with which it is supported on the support edge 118 of the conductor bar 102. It can be supported in such a manner that the support leg 212 has at its free end an upward bend with which it partially encloses the support edge 118 for the purpose of supporting it.

The support leg 212 is adjoined by an arc piece 214 which is adjoined by a clamping leg 216. The conductor end of a connecting conductor (not shown here) is inserted into the window-like opening 116 from the side of the arc piece 214 and can be clamped tight between the clamping leg 216 and the clamping edge 120, acting as abutment. The free end of the clamping leg 216 passes through the window-like opening 116.

The arc piece 214 is initially adjoined by a first partially clamping leg 217 which changes into a second partial clamping leg 218 bent away from the first partial clamping leg 217 at a bending edge 219, so that the first and the second partial clamping leg 217, 218 assume an obtuse angle with one another. The opening of the obtuse angle points into the direction of insertion of the connecting conductor, the bending edge 219 is located approximately in the centre of the clamping leg 216.

The conductor bar 102 approximately has a U-shaped basic form, the connecting end 112 forming the first U-leg and the discharge area 114 being formed by a cross bar 220 and the second U-leg 222. At the free edge of the second U-leg 222, an upward bend 224 is attached. At this upward bend 224, further connecting conductors can be attached by means of which the terminal connection 10 is connected to other assemblies within the switching device housing such as, for example, the release assemblies. In particular, the connecting conductors can be welded on or hard-soldered on this upward bend and screwing-on is also possible.

In the embodiment of a terminal connection which is shown in FIG. 6, the upward bend is elongated to form a discharge bar 226 at the free end of the second U-leg 222. The discharge bar 226 is thus positively connected with the second U-leg 222; it points approximately perpendicularly from the latter in the direction of the window-like opening 116 and projects over the latter.

At the free end of the discharge bar 226, there is another upward bend at which further connecting conductors can then be welded on or riveted on again.

However, the upward bend can also be used directly as terminal connection within the switching device.

Overall, the conductor bar 102 according to this embodiment receives an external contour which resembles the small letter "b". The connecting end 112 of the conductor bar 102 is supported against the discharge bar 226. This increases the mechanical stability of the terminal connection 10.

The advantage is furthermore obtained that the forces acting on the terminal connection 10 during the insertion and detachment of the connecting conductor are absorbed by it as closed system and thus forces acting on other elements of the installation switching device such as, for example, the housing, are reduced.

The conductor bar 102 can be produced in very large numbers inexpensively and simply and in a wide variety of forms, for example as a stamped bent part.

The opening 20 of the terminal connection space 18 is covered by a terminal cover part 22 swivelably connected to the housing part 2.

The terminal cover part 22 comprises a first part-body 322, longitudinally extended in the direction of the rear narrow side 8 and coupled swivelably to the housing part 2 via a pivot pin 232, and a closing part 354 swivelably coupled to its free end via a film hinge 352, which extends approximately in parallel with the rear face 305.

The first part-body 322 comprises a first cover plate 323 which covers the terminal connection space 18 in the lower part, adjoining the mounting side 6, of the narrow side 8 and which carries an approximately tube-like counterpiece to the pivot pin 232 with which it is coupled swivelably at the pivot pin. The first cover plate 323 has a pressure area 330 which is accessible from the outside and can be operated manually.

In the vicinity of the free end of the pressure area 330, the first cover plate 323 is connected via an intermediate piece 325, pointing into the interior of the housing, with a spacing area 338 which also extends in parallel with the rear narrow side 8 in the direction of the face 305 and covers the terminal connection space 18 in the upper part of the narrow side 8, adjoining the rear face 305.

At the free end of the spacing area 338, the aforementioned film hinge 352 with the closing part 354, coupled swivelably thereto, is located.

This is a plate which, at its free end, overlaps at least partially the part 356 at the housing side of the rear face 305. The closing part 354 and the part 356 at the housing side of the rear face thus together form the rear face 305.

At its free end, the closing part 354 carries pins 358 protruding laterally, pointing in the direction of the wide sides 9. In the housing, a rocker-like guide 360 is attached close to the part 356, at the housing side, of the rear face 305, in such a manner that the pins 358 are accommodated in the guide 360.

If then the terminal cover part 22 is swivelled in the direction of the interior of the device by pressure on the pressure area 330, the closing part 354 will slide behind the part 356, at the housing side, of the rear face 305 and is guided by the rocker-like guide 360 displaceably in parallel with the latter. During this process, the angle changes between the closing part 354 and the spacing area 338.

Thus, the closing part 354 and the spacing area 338, in the closed position according to FIG. 6, form an acute angle with one another which is open towards the interior of the housing. In the position according to FIG. 7, the closing part 354 and the spacing area 338 form an obtuse angle opening into the interior of the housing when the terminal cover part 22 is swivelled into the interior of the housing.

On actuation of the terminal cover part and the associated swivelling about the pivot pin 232, the closing part 354 and the spacing area 338 also perform a swivelling movement with respect to one another around the film hinge 352.

By attaching the film hinge between the closing part 354 and the spacing area 338, the closing part 354 can thus shift approximately parallel behind the part 356, at the housing side, of the rear face 305, in a space saving manner. In the case of a rigid coupling as has been previously known in the prior art, the closing part 354 would swivel into the interior of the housing and would there block space for its path of movement which would then no longer be available for functional assemblies or components of the switching device.

The intermediate piece 325 has a connecting area 324 pointing towards the outside. There is at least one terminal opening 26 in the connecting area 24. Starting from the terminal opening 26, a tube-like recess 28 passes through the intermediate piece 325, which penetrates the intermediate piece 325 approximately perpendicularly starting from the connecting area 324 and is thus used as guiding means for a connecting conductor to be connected to the terminal connection 10.

The connecting conductor is guided through the terminal opening 26 in the terminal cover part 22 and, after leaving the tube-like opening 28, encounters the clamping leg 216 of the clamping spring 312.

If the connecting conductor is a rigid conductor, the clamping leg 216 of the clamping spring 312 can be pressed away from the clamping edge 120, by means of the connecting conductor alone, to such an extent that the connecting conductor can be inserted and clamped tight in the window-like opening 116 between the free end of the clamping leg 216 and the clamping edge 120.

In the case of a flexible connecting conductor, the window-like opening 116 must first be opened in another way.

This is done by swivelling the terminal cover part 22.

In the vicinity of the tube-like recess 28, the terminal cover part 22 carries at the intermediate piece 325 a nose 30, pointing towards the clamping leg 216, which is used as spring actuating means.

Naturally, the nose 30 can also be other protruding components, in particular, the function of the nose 30 could also be formed by a web surrounding the exit opening of the tube-like recess 28 in the manner of a collar.

Due to the restoring spring force of the clamping leg 216, the latter presses the nose 30, and thus the terminal cover part 20, towards the outside.

Figure 7:
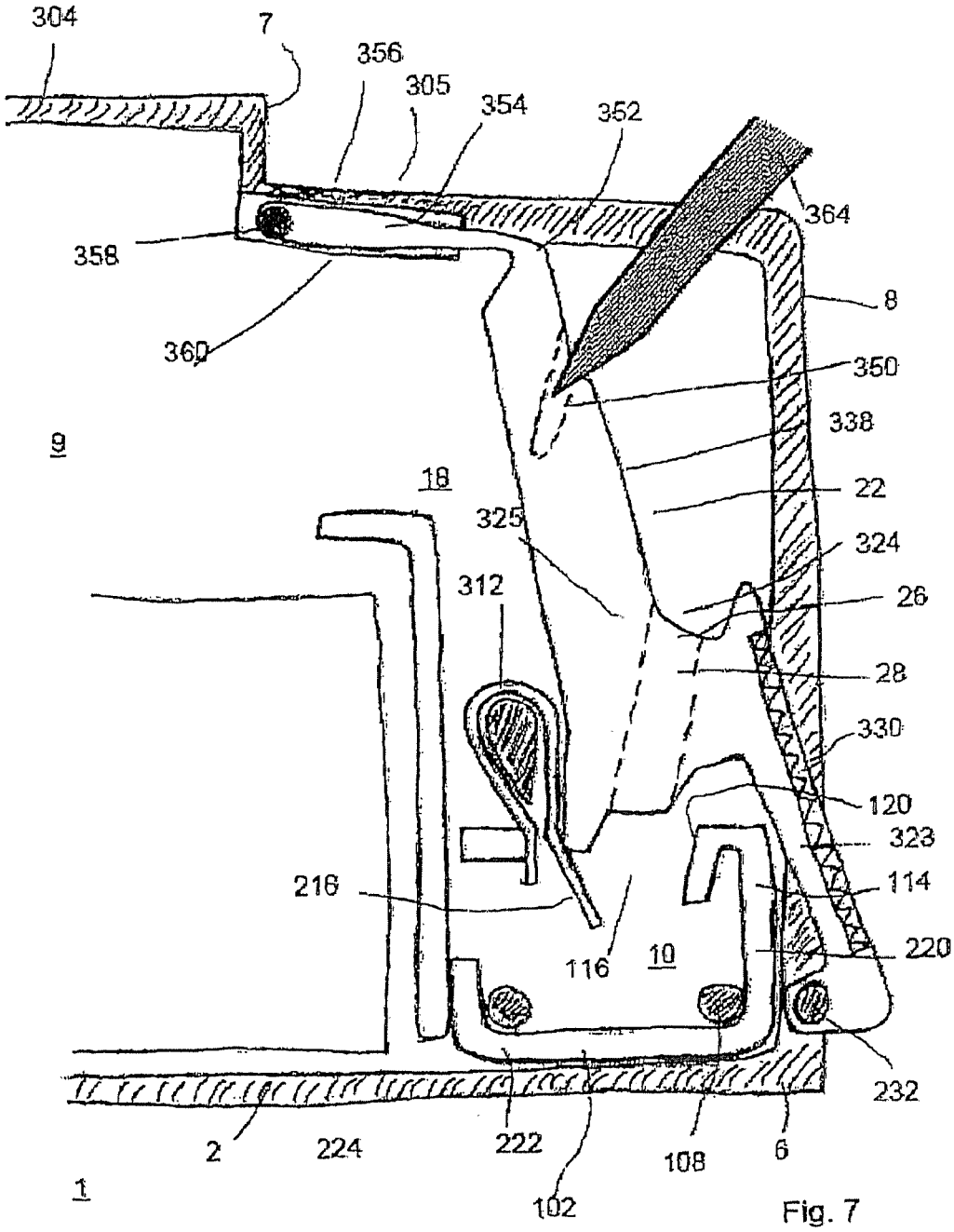
FIG. 7: shows the partial view according to FIG. 6 with the terminal open in the actuating position.

The terminal cover part 22 is swivelled inward by pressure on the pressure area 330 or on the spacing area 338, and the clamping leg 216 is pressed away from the clamping edge 120 via the nose 30 to such an extent that the window-like opening 116 becomes free for inserting the connecting conductor, see FIG. 7.

The nose 30 forms a spring actuating means. It is moulded onto the terminal cover part 22 and constructed in such a manner that, when the cover part is swivelled against the clamping spring, it loads it to open close to the bending edge.

Due to its alignment in such a manner that it loads the clamping spring to open close to the bending edges when the cover part is swivelled, less force expenditure is required during the opening actuation of the terminal cover part, the opening area in the clamping window remaining of the same size.

In an actual example, the first and second part-clamping leg 217, 218 form an angle of approximately 160°. Compared to a clamping spring with straight unbent clamping leg 216, otherwise unchanged, the introduction of the angle halves the actuating force with maximum terminal aperture.

A corresponding procedure is adopted for detaching a connecting conductor clamped on. Pressure on the terminal cover part 22 detaches the clamping between the clamping leg 216 and the connecting conductor in the manner described above so that the latter can be pulled out of the window-like opening 116. Due to the kinked construction of the clamping leg 216, described above, the actuating force for detaching the connecting conductor is also much lower.

As an alternative, the opening movement of the terminal cover part 22 can also be effected by a commercially available longitudinal-slot or crossed-slot screwdriver 364. For this purpose, the latter is placed into a receiving opening 350, suitable for reception (slot-, cross-shaped or spherical recess) at the spacing area 338 at an acute angle and the terminal is opened by a pressure movement with the screwdriver 364.

Even if only one terminal opening 26 and only one tubular recess 28 are shown in the representation according to FIGS. 6 and 7, two or more such terminal openings and recesses can actually also be provided for receiving and connecting a number of connecting conductors in the intermediate piece 325. All connected connecting conductors can be clamped on with a common clamping spring via its clamping legs 216. When the terminal cover part 22 is actuated, all connected conductors are then released simultaneously and can be detached simultaneously.

The terminal cover part 22 with the first part-body 322, the hinge 352 and the closing part 354 can also consist of two material components having different mechanical properties.

These can be joined to one another in a two-component injection moulding process.

The result is then a hard/soft compound. The hard component forms the major component. The first part-body 322 is produced from this. It is used for transferring the actuating forces to the clamping spring 312 and during this process preventing or at least minimizing a bending through of the component.

The soft component is used in the area of the hinge 352 and of the closing part 354.

This provides for easy mobility of the hinge which is required so that the angular change of the angle between the closing part 354 and the first part-body 322 on actuation of the terminal cover part 22 as described above can be easily adjusted.

Flexibility of the closing part 354 also contributes to the latter being able to bend into itself to some extent when it is displaced in parallel with the rear face 305 towards the front narrow side 7 in the rocker-like guide 360 and can thus rest against the front narrow side 305 even more easily and narrowly.

Overall, this leads to a very close guidance of the closing part 354 at the rear face 305, and thus to great space saving during the swivelling of the terminal cover part 322.

LIST OF REFERENCE DESIGNATIONS

1 Installation switching device
2 Housing part
2*a* Plane of separation
4 Front face
5 Rear face
6 Connecting side
7 Front narrow side
8 Rear narrow side
9 Wide side
10 Screwless terminal connection
12 Clamping spring
13*a, b* Part-spring
14 Connecting conductor
16 Stripped connecting conductor end
18 Terminal connection space
20 Terminal connection space opening
22 Cover part, terminal cover part
24 Terminal face
26 Terminal opening
28 Guiding means, hollow body
30 Spring actuating means
102 Conductor bar
104 Web
106 Pin
108 Pin
110 Projection
112 Connecting end
114 Discharge area
116 Window-like opening
118 Support edge
120 Clamping edge
212 Support leg
214 Arc piece
216 Clamping leg
217 First part-clamping leg
218 Second part-clamping leg
2181 Slot
219 Bending edge
220 Crossbar
222 Second U-leg
224 Upward bend
226 Discharge bar
228 Upward bend
230 Pressure area

232 Hinge pin
234 Projection
236 Test opening
304 Front face
305 Rear face
312 Clamping spring
322 First part-body
323 First cover plate
324 Connecting area
325 Intermediate piece
330 Pressure area
338 Spacing area
350 Engagement opening
352 Film hinge
354 Closing part
356 Part, at the housing side, of the rear face
358 Pin
360 Rocker-like guide
364 Screwdriver

What is claimed is:

1. Clamping connection for connecting a conductor to an installation switching device, comprising a clamping spring, acting on the conductor end as compression spring, for clamping tight the conductor end at an abutment, wherein:

the clamping connection comprises a conductor bar with a connecting end and an adjoining discharge area, the conductor bar has at the connecting end a window-like opening with a support edge and a clamping edge, opposite the support edge, at the transition of the connecting end into the discharge area, the clamping spring has a support leg by means of which it is supported on the support edge of the conductor bar, and the support leg is adjoined by an arc piece which is adjoined by a clamping leg, so that the conductor end can be clamped tight between the clamping leg and the clamping edge as abutment.

2. Clamping connection according to claim 1, wherein the arc piece is adjoined by a first part-clamping leg which, at a bending edge, merges into a second part-clamping leg, bent away from the first part-clamping leg, so that the first and the second part-clamping leg assume an obtuse angle with one another, the opening of which points into the direction of insertion of the connecting conductor.

3. Clamping connection according to claim 1, wherein the conductor end can be inserted into the window-like opening from the side of the arc piece.

4. Terminal connection according to claim 1, wherein the clamping leg of the clamping spring is longitudinally slotted so that two closely adjacent part-springs, which can be clamped independently of one another, are produced.

5. Connecting terminal arrangement in a terminal connection space, accessible through a housing opening, of an installation switching device comprising a clamping connection according to claim 1, and a terminal cover part covering the housing opening, wherein the clamping connection is arranged in the terminal connection space in such a manner that a part of the conductor bar is accessible from the outside as calibration contact area.

6. Connecting terminal arrangement in a terminal connection space, accessible through a housing opening, of an installation switching device comprising a clamping connection according to claim 1, and a terminal cover part covering the housing opening, with a test opening, wherein the clamping connection is arranged in the terminal connection space in such a manner that a part of the clamping spring is allocated to the test opening in the terminal cover part (two in 20), and, as a result, an electrical test contacting can be carried out from the outside with the terminal cover part in place.

7. Installation switching device, comprising one or more screwless terminal connections, arranged at an outgoing side, according to claim 1, and one or more screw terminals arranged at an incoming side.

8. Clamping connection according to claim 2, wherein the conductor bar is approximately U-shaped, the connecting end forming one U-leg and the discharge area being formed by the crossbar and the other U-leg.

9. Clamping connection according to claim 3, wherein the clamping spring runs outside the U-shaped conductor bar so that, when it is installed into the terminal connection space of a switching device, it is accessible there for an actuating tool or a tightening element.

10. Clamping connection according to claim 8, wherein an upward bend for attaching further conductor bars is provided at the free end of the other U-leg.

11. Clamping connection according to claim 8, wherein a discharge bar is moulded onto the free end of the other U-leg.

12. Clamping connection according to claim 10, wherein the discharge bar extends approximately perpendicularly to the other U-leg and the side of the connecting end opposite to the clamping edge is supported on the discharge bar.

13. Installation switching device with a housing comprising two shell-shaped housing parts, with a front and rear face, a mounting side, front and rear narrow sides and wide sides, and with at least one terminal connection according to claim 1, which is fixed in position in a terminal connection space of the housing.

14. Installation switching device according to claim 5, wherein the terminal connection space is laterally limited by the housing wide sides and is open at least towards the front face, that the opening of the terminal connection space can be covered by a terminal cover part which is swivelably connected to the housing and which has a connecting area with a number of terminal openings corresponding to the number of connecting conductors to be connected, and guiding means, moulded onto each terminal opening, for the connecting conductors, and that spring actuating means are moulded onto the cover part and are arranged in such a manner that, when the cover part is swivelled against the clamping spring, they load the latter in a manner so as to open it.

15. Installation switching device according to claim 6, wherein the terminal cover part is resiliently loaded by the clamping spring in opposition to the direction of insertion of the external connecting conductor and can be pressed against the clamping spring.

16. Installation switching device according to claim 13, wherein the spring actuating means are formed by the guiding means, moulded onto each terminal opening, for the connecting conductors.

17. Terminal connection according to claim 12, wherein the clamping leg of the clamping spring is longitudinally slotted so that two closely adjacent part-springs, which can be clamped independently of one another, are produced.

18. Connecting terminal arrangement in a terminal connection space, accessible through a housing opening, of an installation switching device comprising a clamping connection according to claim 11, and a terminal cover part covering the housing opening, with a test opening, wherein the clamping connection is arranged in the terminal connection space in such a manner that a part of the clamping spring is allocated to the test opening in the terminal cover part (two in 20), and, as a result, an electrical test contacting can be carried out from the outside with the terminal cover part in place.

19. Installation switching device with a housing comprising two shell-shaped housing parts, with a front and rear face, a mounting side, front and rear narrow sides and wide sides, and with at least one terminal connection according to claim 11, which is fixed in position in a terminal connection space of the housing.

20. Installation switching device according to claim 5, comprising one or more screwless terminal connections, arranged at the outgoing side, and one or more screw terminals arranged at the incoming side.

* * * * *